US008011737B2

(12) United States Patent
Wang et al.

(10) Patent No.: US 8,011,737 B2
(45) Date of Patent: Sep. 6, 2011

(54) WHEEL FOR TOY VEHICLE

(75) Inventors: Kui-Jun Wang, Shenzhen (CN); Feng-Xiang Tang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 174 days.

(21) Appl. No.: 12/432,752

(22) Filed: Apr. 30, 2009

(65) Prior Publication Data

US 2010/0237686 A1 Sep. 23, 2010

(30) Foreign Application Priority Data

Mar. 21, 2009 (CN) ..... 2009 1 0301003

(51) Int. Cl.
*B60B 15/28* (2006.01)

(52) U.S. Cl. ..... 301/53.5; 301/5.22; 446/431; 446/465

(58) Field of Classification Search ..... 301/5.22, 301/41.1, 53.5; 280/755, 758, 759; 446/431, 446/457, 458, 465; 404/130
See application file for complete search history.

(56) References Cited

U.S. PATENT DOCUMENTS

| | | | | | |
|---|---|---|---|---|---|
| 414,642 | A | * | 11/1889 | Herrick | 74/570.2 |
| 1,328,052 | A | * | 1/1920 | Morral | 301/65 |
| 2,687,918 | A | * | 8/1954 | Bell et al. | 301/5.22 |
| 2,909,389 | A | * | 10/1959 | Wilborn | 301/5.22 |
| 3,314,726 | A | * | 4/1967 | Rehnborg et al. | 301/5.22 |
| 3,346,303 | A | * | 10/1967 | Wesley | 301/5.22 |
| 3,716,093 | A | * | 2/1973 | Tsuchiya | 152/450 |
| 3,913,980 | A | * | 10/1975 | Cobb, Jr. | 301/5.22 |
| 4,674,356 | A | * | 6/1987 | Kilgore | 74/570.2 |
| 5,048,367 | A | * | 9/1991 | Knowles | 301/5.22 |
| 5,503,464 | A | * | 4/1996 | Collura | 301/5.22 |
| 6,719,374 | B2 | * | 4/2004 | Johnson | 301/5.22 |

* cited by examiner

*Primary Examiner* — Kip Kotter
(74) *Attorney, Agent, or Firm* — Frank R. Niranjan

(57) ABSTRACT

A wheel for a toy vehicle includes a rim, a tire, and a ballast. The rim includes an outer circumferential surface. The tire is attached to the outer circumferential surface of the rim. The tire and the rim cooperatively define a ring-shaped receiving channel therebetween. The ballast is received in the ring-shaped receiving channel, and slidably connected to the outer circumferential surface of the rim. The weight of the ballast is greater than the frictional force between the ballast and the rim.

13 Claims, 7 Drawing Sheets

WHEEL FOR TOY VEHICLE

BACKGROUND

1. Technical Field

The present disclosure relates to wheels and, particularly, to a wheel for a toy vehicle with low center of gravity.

2. Description of Related Art

Many different types of toys are known and have become widespread and popular over the years. In particular, toy vehicles have become very popular with children over the years. A disadvantage of such toy vehicles is that the center of gravity thereof is usually high, and the toy vehicles easily turns over when on a slope.

What is needed, therefore, is a wheel for a toy vehicle which can lower the center of gravity of the toy vehicle to overcome or at least alleviate the above-described problems.

BRIEF DESCRIPTION OF THE DRAWINGS

Many aspects of the present wheel for a toy vehicle can be better understood with reference to the accompanying drawings. The components in the drawings are not necessarily drawn to scale, the emphasis instead being placed upon clearly illustrating the principles of the present wheel for a toy vehicle.

DETAILED DESCRIPTION

Embodiments of the present disclosure will now be described in detail below, with reference to the accompanying drawings.

Figure 1:
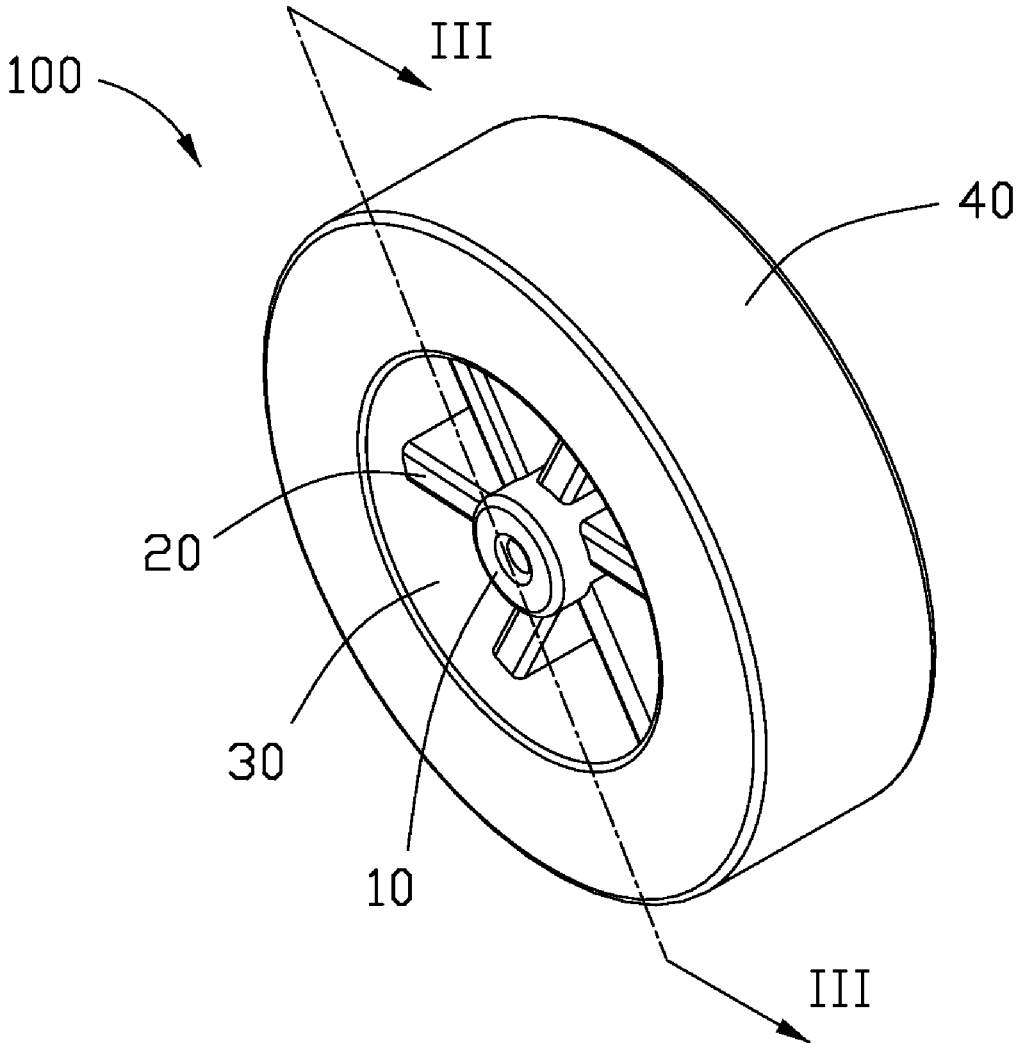
FIG. 1 is a schematic view of a wheel of a toy vehicle according to a first exemplary embodiment.
Figure 2:
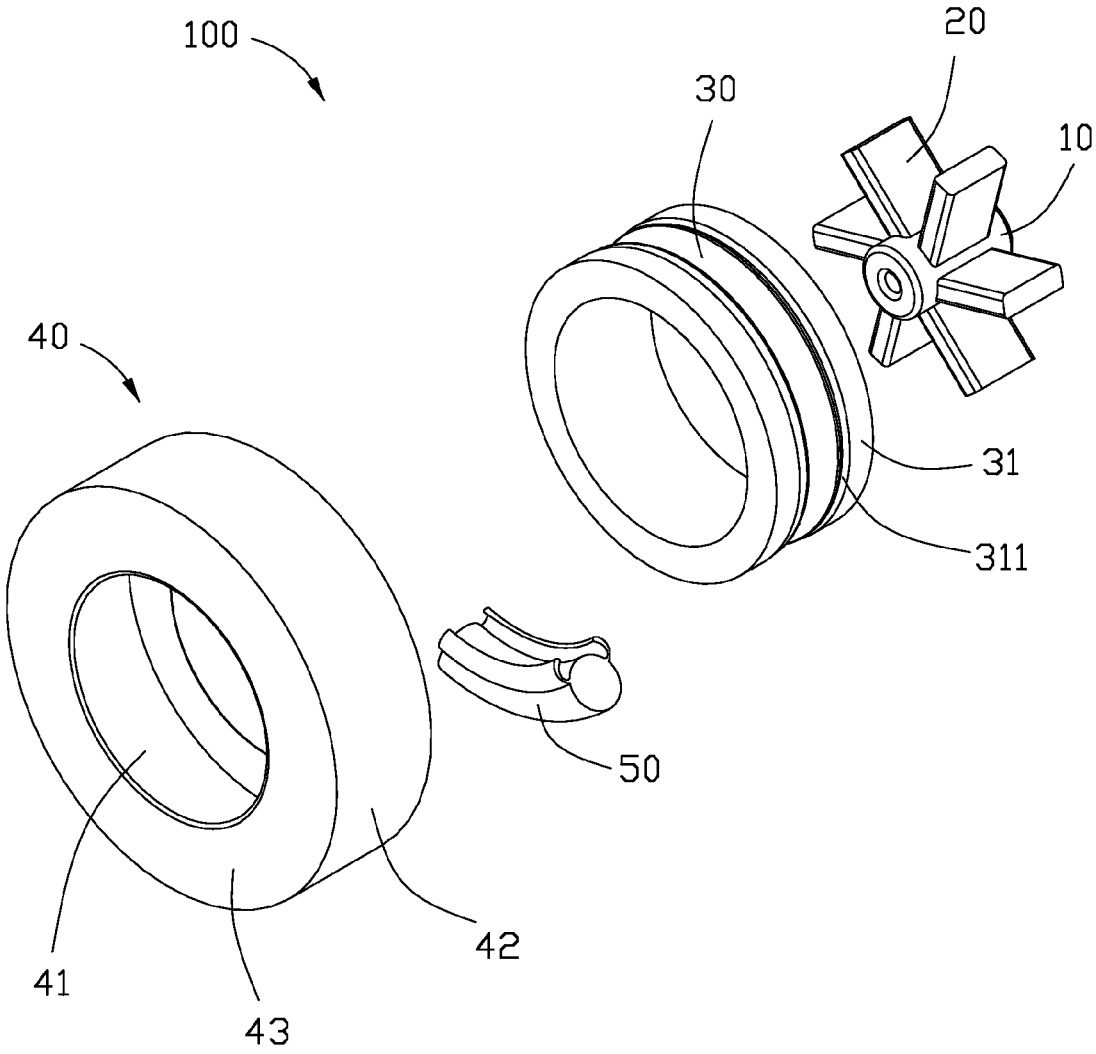
FIG. 2 is a schematic, exploded view of the wheel of FIG. 1.

Referring to FIG. 1 and FIG. 2, a wheel 100 for a toy vehicle, according to a first exemplary embodiment, is shown. The wheel 100 includes a hub 10, a number of spokes 20, a rim 30, a tire 40, and a ballast 50.

The hub 10 is secured to a wheel axle (not shown) of the toy vehicle, thus, the wheel 100 can be rotated. The spokes 20 radially extend from the hub 10, and are connected between the hub 10 and the rim 30.

Figure 3:
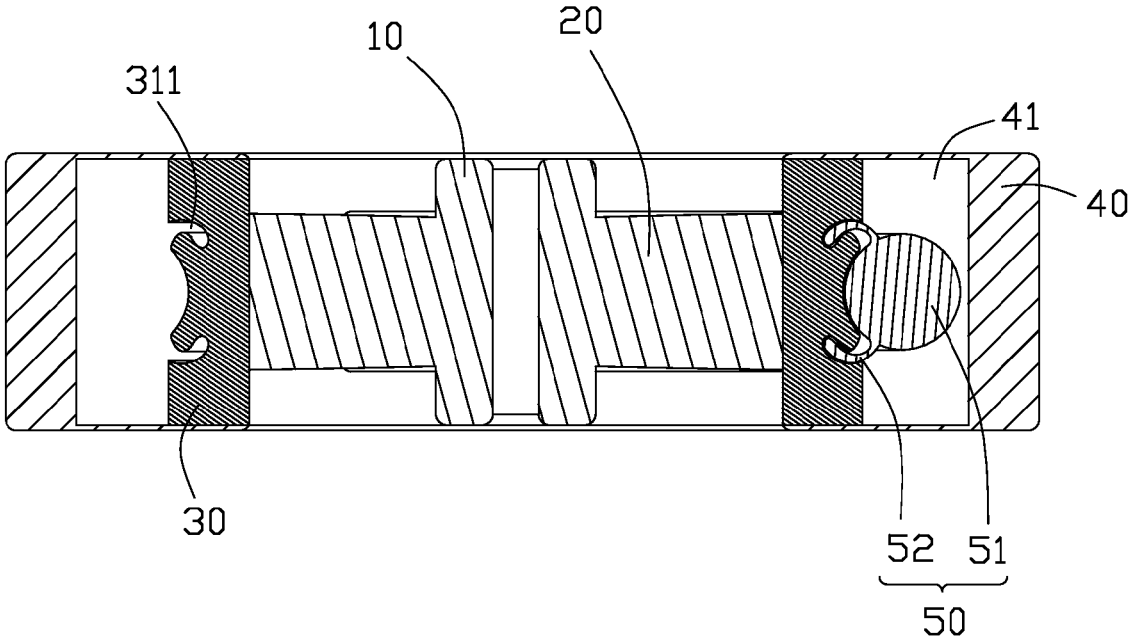
FIG. 3 is a cross-section view taken along line III-III of FIG. 1.

Further referring to FIG. 3, the rim 30 includes an outer circumferential surface 31, and defines two circular guiding slots 311 on the outer circumferential surface 31. The two circular guiding slots 311 are substantially parallel to each other. The two circular guiding slots 311 extend along the circumference of the rim 30.

The tire 40 is attached to the outer circumferential surface 31 of the rim 30. The tire 40 and the rim 30 cooperatively define a ring-shaped receiving channel 41 in between. In the present embodiment, the tire 40 includes a circumferential wall 42 and two opposite side walls 43. The two opposite side walls 43 extend from an inner side of the circumferential wall 42 towards the outer circumferential surface 31 of the rim 30.

The two opposite side walls 43 are attached to the outer circumferential surface 31 of the rim 30.

Figure 4:
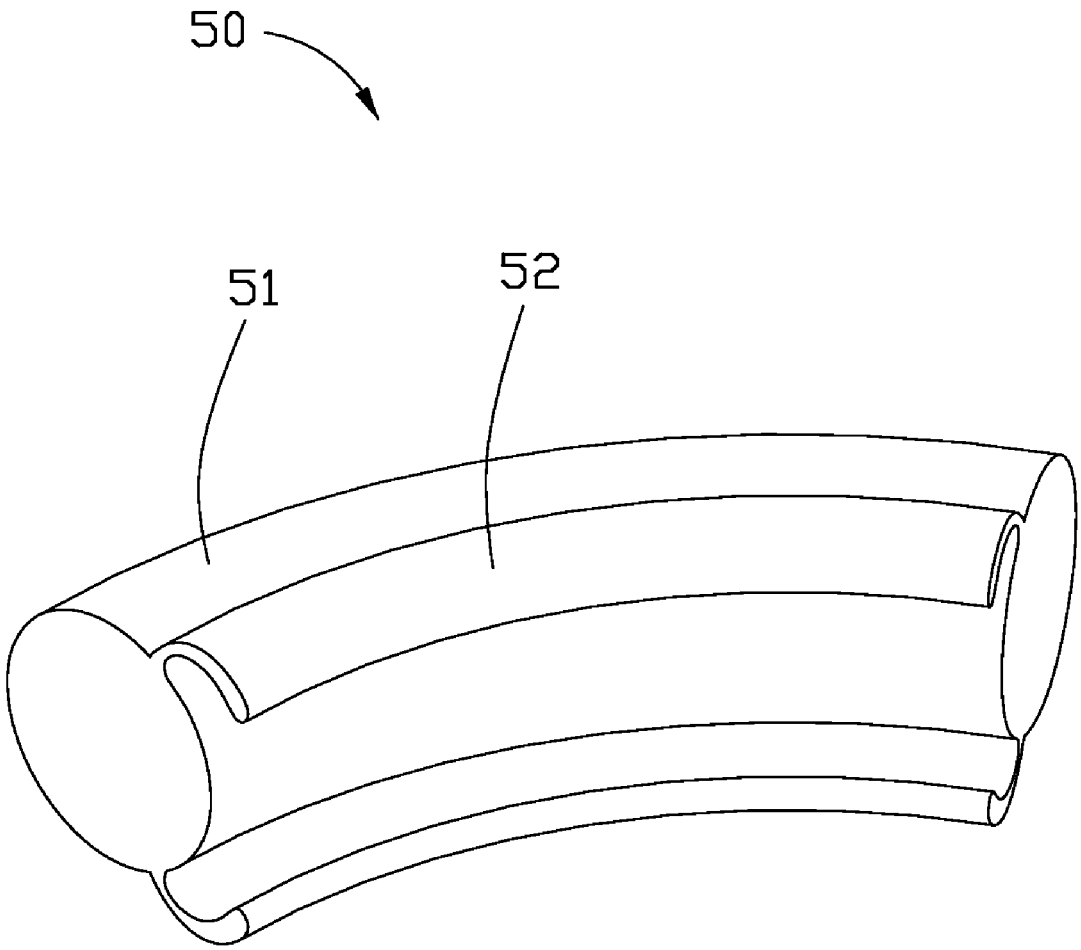
FIG. 4 is a schematic view of a ballast of the wheel of FIG. 1.

The ballast 50 is received in the receiving channel 41 and slidably connected to the outer circumferential surface 31 of the rim 30. Further referring to FIG. 4, the ballast 50 includes a main body 51 and two sliders 52 extending from the main body 51 towards the outer circumferential surface 31 of the rim 30. The main body 51 is arc-shaped. The length of the main body 51 can be shorter than one sixth of the perimeter of the rim 30. Preferably, the length of the main body 51 is in a range from one sixth of the perimeter of the rim 30 to one eighth of the perimeter of the rim 30. The two sliders 52 are received in the two circular guiding slots 311 of the rim 30, and slidable in the circular guiding slots 311.

In order to prevent the ballast 50 from rotating with the rim 30, the weight of the ballast 50 should be greater than the frictional force between the ballast 50 and the rim 30. Both of the ballast 50 and the rim 30 can be made of metal, such as steel, copper etc., to increase the weight of the ballast 50 and decrease the frictional force between the ballast 50 and the rim 30. Preferably, the circular guiding slots 311 of the rim 30 are filled with lubricant to decrease the frictional force between the ballast 50 and the rim 30.

When the wheel 100 rotates, the ballast 50 will slide on the outer circumferential surface 31 of the rim 30, and remains close to ground (not show). Thus, the ballast 50 can lower the center of gravity of the wheel 100, and accordingly, can lower the center of gravity of any toy vehicle using the wheel 100. Therefore, the toy vehicle using the wheel 100 can run more stably.

Figure 5:
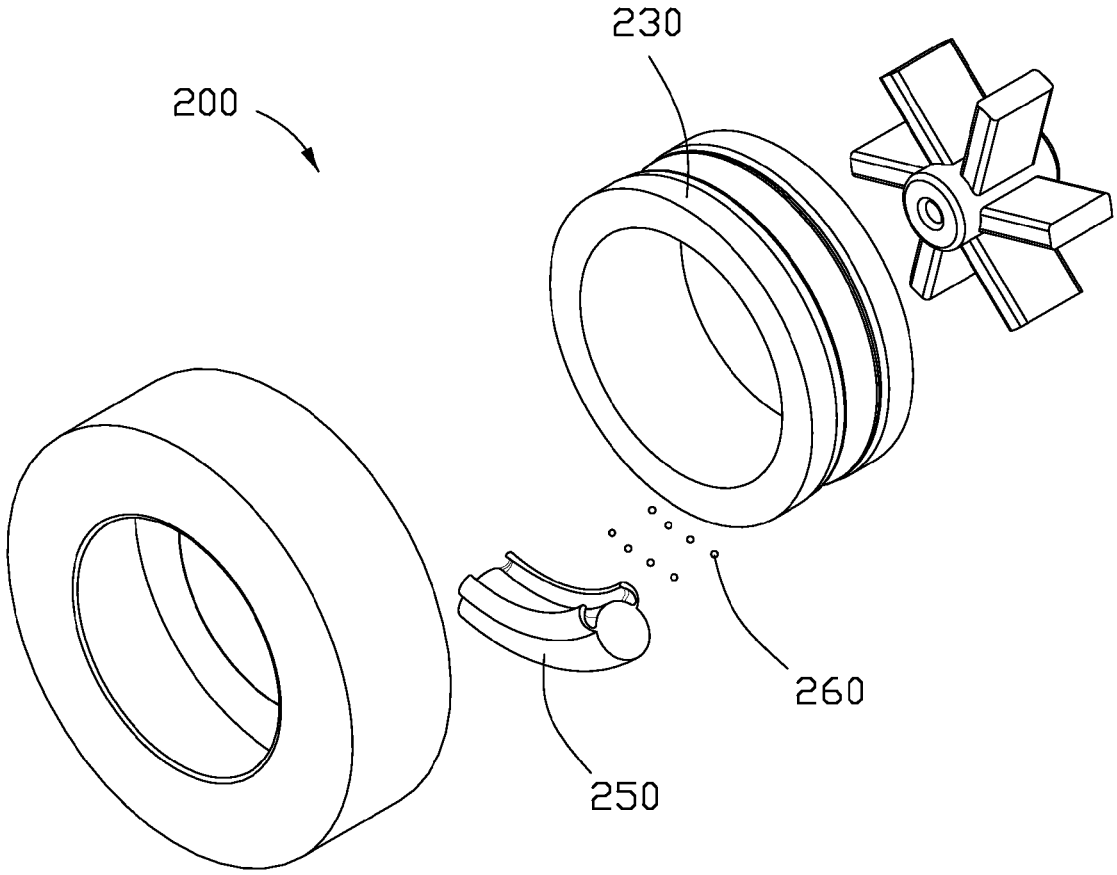
FIG. 5 is a schematic, exploded view of a wheel of a toy vehicle according to a second exemplary embodiment.
Figure 6:
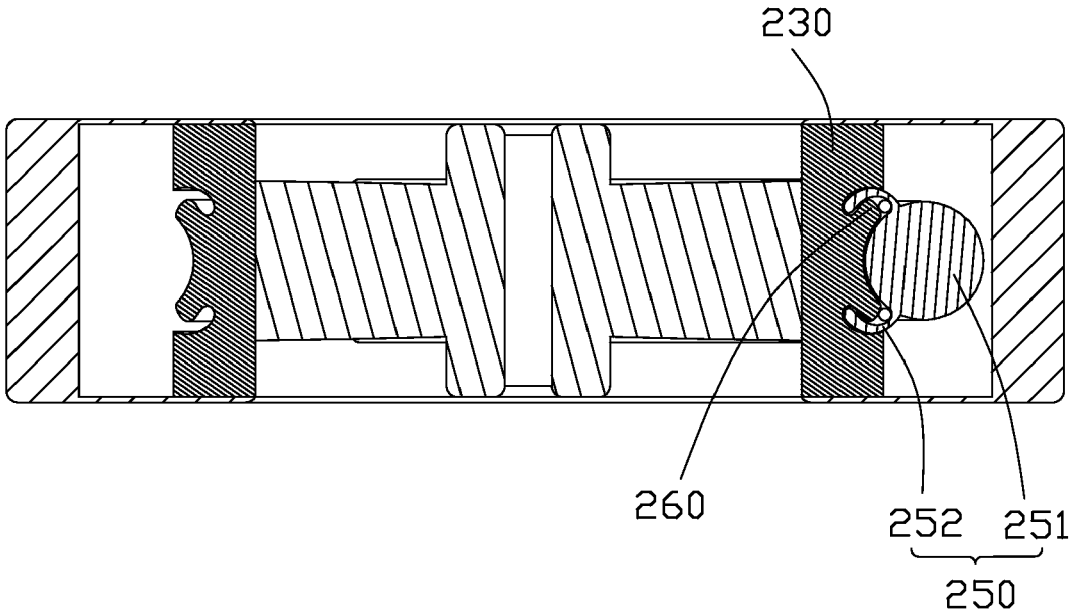
FIG. 6 is a cross-section view of the wheel of FIG. 5.
Figure 7:
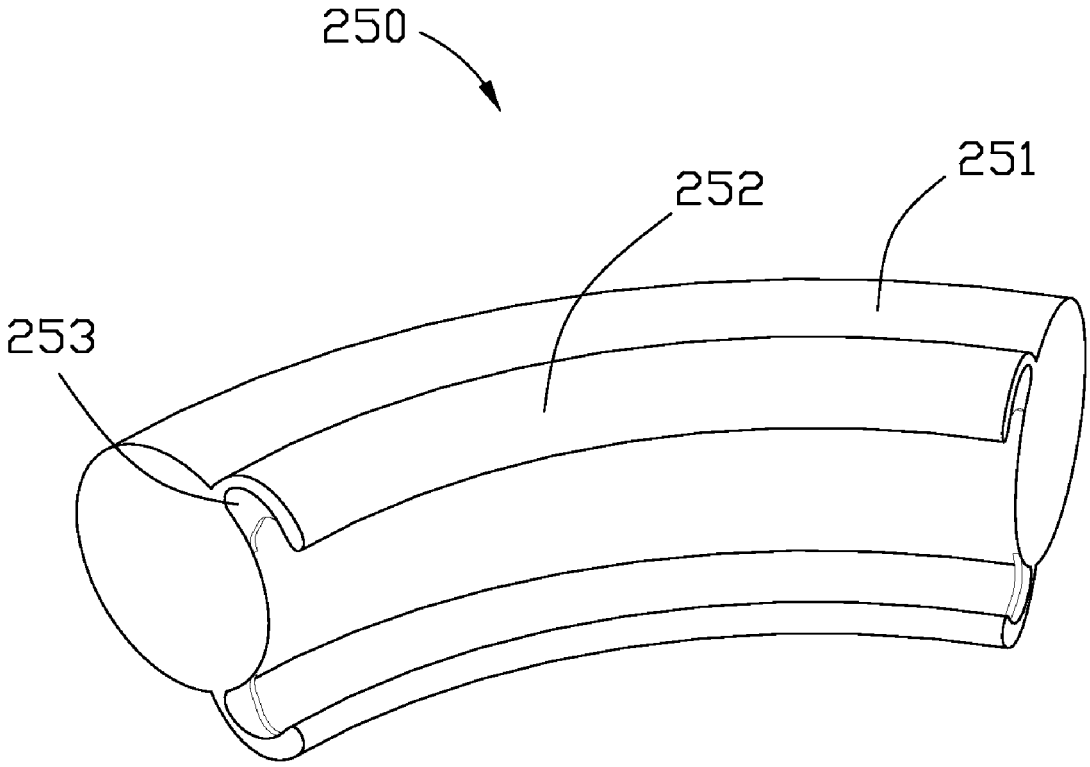
FIG. 7 is a schematic view of a ballast of the wheel of FIG. 5.

Referring to FIG. 5 to FIG. 7, a wheel 200 for a toy vehicle, according to a second exemplary embodiment, is shown. The wheel 200 is similar to the wheel 100 of the first exemplary embodiment. The wheel 200 includes a rim 230, and a ballast 250 including a main body 251 and two sliders 252. The difference between the wheel 200 and the wheel 100 is that the wheel 200 further includes a number of balls 260 disposed between the rim 230 and the sliders 252 of the ballast 250. The balls 260 can be made of plastic or metal. In the present embodiment, the balls 260 are made of metal. The ballast 250 further includes two limiters 253 respectively at the two ends of each slider 252. The two limiters 253 are configured for preventing the balls 260 from falling out of the sliders 252. The balls 260 can decrease the frictional force between the ballast 250 and the rim 230, and further lower the center of gravity of the wheel 200.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. A wheel for a toy vehicle comprising:

a rim comprising an outer circumferential surface;

a tire attached to the outer circumferential surface of the rim, the tire and the rim cooperatively defining a ring-shaped receiving channel therebetween; and a ballast received in the ring-shaped receiving channel, and slidably connected to the outer circumferential surface of the rim, the weight of the ballast being greater than the frictional force between the ballast and the rim, wherein the rim defines two circular guiding slots on the outer circumferential surface, and the ballast comprises a main body and two sliders received in the two circular guiding slots.

2. The wheel as claimed in claim 1, wherein the two circular guiding slots are substantially parallel to each other and extend along the circumference of the rim.

3. The wheel as claimed in claim 1, wherein the tire comprises a circumferential wall and two opposite side walls, the two opposite side walls extending from an inner side of the circumferential wall towards the outer circumferential surface of the rim and being attached to the outer circumferential surface of the rim.

4. The wheel as claimed in claim 1, wherein the main body of the ballast is arc-shaped.

5. The wheel as claimed in claim 4, wherein the length of the main body is shorter than one sixth of the perimeter of the rim.

6. The wheel as claimed in claim 5, wherein the length of the main body is in a range from one sixth of the perimeter of the rim to one eighth of the perimeter of the rim.

7. The wheel as claimed in claim 1, wherein both of the ballast and the rim are made of metal.

8. The wheel as claimed in claim 7, wherein the metal is steel or copper.

9. The wheel as claimed in claim 1, wherein the circular guiding slots of the rim is filled with lubricant.

10. The wheel as claimed in claim 1, wherein a plurality of balls are disposed between the rim and the ballast.

11. The wheel as claimed in claim 10, wherein the plurality of balls are made of plastic or metal.

12. The wheel as claimed in claim 10, wherein the ballast further comprises two limiters respectively at the two ends of each slider, the two limiters being configured for preventing the balls from falling out of the sliders.

13. The wheel as claimed in claim 1, further comprising a hub capable of being secured to a wheel axle, and a plurality of spokes radially extending from the hub, the spokes being connected between the hub and the rim.

* * * * *